US007035556B2

(12) United States Patent
Behnke et al.

(10) Patent No.: US 7,035,556 B2
(45) Date of Patent: Apr. 25, 2006

(54) METHOD AND APPARATUS FOR PREVENTING FIRE IN PRINTING MACHINES

(75) Inventors: Knut Behnke, Flintbek (DE); Hans-Otto Krause, Eckernfoerde (DE); Frank-Michael Morgenweck, Molfsee (DE); Domingo Rohde, Kiel (DE); Detlef Schulze-Hagenest, Molfsee (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 43 days.

(21) Appl. No.: 10/769,342

(22) Filed: Jan. 30, 2004

(65) Prior Publication Data

US 2004/0228643 A1 Nov. 18, 2004

(30) Foreign Application Priority Data

Feb. 12, 2003 (DE) ..... 103 05 775

(51) Int. Cl.
*G03G 15/20* (2006.01)

(52) U.S. Cl. ..... 399/33; 399/336; 219/216

(58) Field of Classification Search ..... 219/216, 219/678, 679, 690, 692, 693; 399/67, 69, 399/70, 320, 322, 324, 328, 334, 336, 33
See application file for complete search history.

(56) References Cited

U.S. PATENT DOCUMENTS 4,511,778 A * 4/1985 Takahashi et al. ..... 219/691
5,423,260 A 6/1995 Goldberg et al.

FOREIGN PATENT DOCUMENTS

DE 2024979 5/1970
DE 10064561 A1 6/2002
EP 0 798 116 A1 1/1997

* cited by examiner

*Primary Examiner*—Hoang Ngo
(74) *Attorney, Agent, or Firm*—Lawrence P. Kessler

(57) ABSTRACT

A method and an apparatus for preventing damage inside a printing machine caused by the radiation of microwaves emanating from microwave mechanisms. Undesired effects of the microwave radiation are automatically detected and then limited by countermeasures. Special provision is made for detecting an electrical discharge, or smoldering or burning of a printing medium inside the microwave mechanism, and then initiating suitable countermeasures.

16 Claims, 1 Drawing Sheet

METHOD AND APPARATUS FOR PREVENTING FIRE IN PRINTING MACHINES

FIELD OF THE INVENTION

The present invention concerns a method and apparatus for preventing damage inside a printing machine caused by the radiation of microwaves from microwave mechanisms, mainly from microwave fusing mechanisms.

BACKGROUND OF THE INVENTION

In order to apply an image to a printing medium inside a printing machine, toner is transferred to the printing medium in a developing device. This printing medium can, for example, be a sheet of paper. If more than one color is to be transferred to the printing medium, several developing devices can be incorporated into the printing machine.

In an electrophotographic printing machine, the toner can be transferred onto a photoelectric drum onto which a latent image previously was exposed. In this process the toner is transferred only onto the exposed areas. Other processes are also possible, in which the toner is transferred only to the unexposed areas. Thereafter, the toner can be further transferred onto a rubber blanket cylinder.

By means of a back-up developing roller and under the influence of an electric field, the toner can be transferred to the printing medium that is being conveyed through the nip between the rubber blanket and the back-up roller.

In order to protect the image that is created in this way from smearing and other damage, the toner is fused onto the printing medium. Fusing of the toner can be accomplished after all of the desired layers of toner have been transferred onto the printing medium. For this purpose, a fusing mechanism, for example, to be located downstream from the last developing device in the printing machine. Alternatively, provision can also be made for fusing the toner downstream from each developing device.

Typical fusing mechanisms fuse the layers of toner on the printing medium by heating the layers of toner and the printing medium. In this process, the toner is heated to a temperature above its glassification temperature and bonded with the printing medium.

Fusing of the toner on the printing medium may often be done inside the fusing mechanism by the application of pressure and heat. For this purpose, a fuser roller and a back-up roller are provided. The printing medium is then fed into the nip formed by the two rollers. The fuser roller and back-up roller are heated for this purpose.

In order to heat the layers of toner and the printing medium, as described in U.S. Pat. No. 6,665,516, issued on Dec. 16, 2003, a microwave mechanism may be used, including a microwave applicator. For this purpose, the printing medium is fed through at least one microwave applicator, in which it and the layers of toner are heated by microwave radiation.

Additional microwave mechanisms may be provided inside a printing machine. For example, microwave mechanisms may be used to preheat the layer of toner before the actual fusing process takes place, which can then be done, for example, by a fuser mechanism containing a fuser roller and a back-up roller.

When microwave mechanisms are used inside the printing machine, the radiation of microwaves can cause undesired effects. For example, the microwave mechanism can be improperly operated or controlled such that the energy level of the microwave radiation is too high. The result can be that parts of the microwave mechanism or a printing medium that is in the microwave mechanism can become overheated. Then it is possible that the printing medium will begin to smolder or even catch fire.

The same undesired effects of the microwave radiation can also occur when the printing medium is subjected to the microwave radiation and remains for a prolonged period of time in the field of the microwave radiation. The energy induced into the printing medium can then be sufficient to cause smoldering or even allow burning to begin.

This prolonged presence in the field can be caused by the printing medium not being aligned properly and lying so crookedly in the printing machine that the printing medium becomes jammed in the printing machine.

It is also conceivable that, based upon a faulty conveyance mechanism or through an incorrect adjustment of the speed of conveyance, the printing medium is conveyed so slowly through the microwave mechanism that in this way, too, the induced energy becomes too great for the printing medium and it begins to smolder or burn.

Electrical discharge can be caused inside the microwave mechanism by dirt accumulations or faulty apparatus. The undesired effect of the microwave radiation can then be that this electrical discharge causes damage to the printing medium (at least point-damage) or peripheral damage to the toner image or to the microwave mechanism itself.

SUMMARY OF THE INVENTION

It is therefore the objective of the present invention to prevent possible damage by microwave radiation in a fuser mechanism of a printing machine.

The objective of the process aspect of the invention is achieved in that an undesired effect of the microwave radiation is automatically detected and then limited by countermeasures.

With respect to the apparatus, the objective of the invention is achieved by at least one detection mechanism for detecting an undesired effect of the microwave radiation and one mechanism for actuating at least one mechanism for executing suitable countermeasures.

By such a mechanism, undesired effects of the microwave radiation can be detected in a timely manner so that countermeasures can be initiated to prevent damage. Damage that can be anticipated to occur inside the printing machine and/or to the printing medium can at least be limited.

It can be detected, for example, that the printing medium has caught fire or that a fire is about to start. It may also be possible that this danger can be ascertained by indirect observations. It can, for example, be concluded that the characteristics of microwave radiation constitute a danger, which then suggests corresponding undesired effects.

If, therefore, such an undesired effect is detected or at least suspected, countermeasures can be initiated. Among such countermeasures are actions such as, for example, cutting the power to the microwave mechanism, neutralizing the microwave radiation coming from the microwave mechanism, or acting upon the microwave mechanism such that the resonance condition required for the microwave radiation is removed. Cutting power to the microwave mechanism can be successful within μ-seconds, so that no more microwaves impinge on the printing medium and/or the toner. Consequently, according to the invention, cutting power to the microwave mechanism is preferred.

To execute this process, provision is beneficially made for at least one detection mechanism for detecting an undesired effect of the microwave radiation and for actuating at least one mechanism for executing countermeasures.

In addition, in the event of smoldering or actual burning, or in case such an eventuality is anticipated, such an occurrence can be directly confronted and/or extinguished.

Operation of the microwave mechanism can be set to the paper weight of the printing medium. If, then, a printing medium with an unexpected paper weight is mistakenly conveyed into the range of the microwave mechanism, then, in particular, the level of moisture brought into the microwave mechanism by the printing medium will change.

If, then, for example, a printing medium with a lower paper weight than was anticipated is conveyed into the microwave mechanism, it may be that the microwave mechanism is incorrectly adjusted for this printing medium to the extent that the printing medium becomes overheated, loses too much moisture, and finally begins to smolder or burn.

Consequently the paper weight of the printing medium should accurately be ascertained. Preferably, this should be done before the printing medium is fed into the microwave mechanism. Provision can be made, for example, that the paper weight of the printing medium is determined in the feeder of the printing machine, in the area of the developing device, or in some other place inside the printing machine.

If an incorrect paper weight is detected, appropriate countermeasures can be taken to prevent burning or smoldering. Provision can be made for stopping further conveyance of the printing medium and/or for the microwave mechanism to be turned off.

For ascertaining the paper weight according to the invention, provision is made for a paper weight ascertaining mechanism preferably in the area of the microwave mechanism.

It can, for example, consist of a low-power microwave mechanism. A conclusion may be drawn that a particular paper weight is not correct based on the facts that (1) printing media of different paper weights generally have different moisture content, (2) the resonance conditions of the microwave mechanism change on the basis of the different moisture content, and (3) such change can be detected by appropriate measuring elements.

The paper weight determining mechanism can also use capacitance measuring elements to detect printing media with different moisture levels. And then, by balancing values, the mechanisms can detect a printing medium with the incorrect paper weight.

Provision can be made, in particular, for the paper weight determining mechanism to recognize that deviations from the anticipated paper weight that lie within a specific range are acceptable. The limits of this range can be set externally or by selecting the level of precision of paper weight determination. It depends upon what can be best attuned to deviations in the paper weight within a printing medium type.

If the printing medium remains in the environment of the microwave mechanism for a prolonged period of time, it can become overheated and, in the worst-case scenario, catch on fire.

Consequently, provision is beneficially made for detecting such a prolonged presence. This can be done according to the invention by a paper jam detection mechanism, the apparatus for which is located in the area of the microwave mechanism.

The prolonged presence of different printing media can be detected by such paper jam detection mechanisms. Use of the jam detection mechanism is not limited to paper.

The prolonged presence can beneficially be detected by optical sensors. Consequently, the paper jam detection mechanisms according to the invention preferably incorporates at least one optical sensor.

These sensors can, for example, be in the form of light barriers or line sensors.

Using light barriers, it is conveniently possible to detect the movement of a printing medium inside the printing machine. If the printing medium is conveyed by a transparent conveyor belt or another mechanism that allows the printing medium to be detected from both the upper side and the lower side of its travel path, provision is made according to the invention that the light barriers are such that they are aligned at right angles to the plane of the printing medium. A light emitter can then, for example, be mounted above and a light sensor below the plane of the printing medium, i.e., above or below the travel path.

Provision can also be made for light emitters and light sensors to be such that they work reflectively. The light emitter emits light that is then reflected from a printing medium and is then detected by the light sensor.

Provision can be made, in particular, for the printing medium to travel through two light barriers in direct proximity to the microwave mechanism. The distance between these light barriers should be such that the leading edge of the printing medium during proper operation of the printing machine travels with sufficient speed through both light barriers so that the printing medium cannot begin to smoke or catch fire when it is continuously subjected to the microwave radiation.

If, for example, the printing medium travels too slowly through the microwave mechanism, then once the conveyor speed falls below the minimally acceptable speed, the infused energy can be sufficient to set the printing medium ablaze. If, then, the conveyor speed falls below a minimally acceptable speed, the optical sensors according to the invention can detect it in a timely manner.

If a jam or another obstruction to the conveyance of the printing medium arises, this situation can also be appropriately detected and countermeasures can be initiated.

From the speed of the conveyance of the printing medium and the distance between light barriers, a point in time can be calculated at which the printing medium should have been conveyed through the second light barrier. A failure to detect the printing medium at this point in time indicates a paper jam, but if not a paper jam, then at least an improper travel of the printing medium.

If the printing medium, for example, should begin to smoke within 500 ms of coming under the influence of the microwave radiation, then provision is made for selecting the distance between the light barriers to be such that the printing medium runs through both light barriers in less than 500 ms, at a conveyor speed of 500 mm/s, the maximum distance between the light barriers would be 250 mm.

Light barriers can also be located above and/or below the travel path. These light barriers should be mounted such that they can detect heaving of the printing medium, particularly inside the microwave mechanism. For this purpose they can, for example, be integrated into the side walls of the microwave mechanism, and be aligned there at right angles to the printing medium's direction of travel and parallel to the plane of the printing medium. The distance to the printing medium should be selected such that routine static upward movements of the printing medium are not mistakenly identified as heaving.

If the printing medium becomes tilted or begins to smoke, the light barrier will be broken by the raised printing medium or, as the case may be, by the smoke, and further damage to the printing medium can be prevented or at least, in the case of smoke, be quickly detected. It is also possible that such light barriers can be mounted upstream from and/or downstream from the microwave mechanism. Here, they can then be installed under and/or above the travel path where they can detect heaving of the printing medium directly.

Provision can also be made in addition, or exclusively, in an alternative embodiment for the above-mentioned light barriers to be aligned in the direction of conveyor travel. In particular, if additional light barriers are installed, the speed and the precision with which heaving of the printing medium can be detected are increased, thereby enhancing the certainty that heaving, which could otherwise, for example, lead to a jamming of the printing medium, will be detected.

In a further embodiment, at least one light barrier can be provided as a line sensor with corresponding light emitters and receivers. This light barrier should then be set in place upstream from the microwave mechanism along the path of conveyance of the printing medium. Using this line sensor, the entire width of the travel path should be monitored such that the width or the shape of the printing medium that is to be conveyed through the microwave mechanism is detected. Heaving of the printing medium or an incorrect, particularly an overly large, width of the printing medium can be identified via a signal that is correlated to the default width. If such an incorrectly aligned printing medium entered into the microwave mechanism, a paper jam could ensue. A paper jam can be prevented in advance. For this purpose, the light barrier can be such that the light emitter is located below the travel path and the receiver above the travel path. Here, too, an equivalent embodiment is conceivable in which the light emitter and the receiver operate reflectively.

The optical sensors can also be in the form of a system for detecting the speed of the printing medium by image detection. Such systems are currently being marketed. If, while using such a system, a lack of movement or even a reduction in the speed of conveyance is detected, appropriate measures can be initiated before the microwave radiation creates an undesired effect.

In a further advantageous embodiment of the invention, provision is made for the prolonged presence of the printing medium to be detected by acoustical sensors. For this purpose the paper jam detection mechanism according to the invention should beneficially incorporate at least one acoustical sensor.

When heaving of the printing medium occurs inside the microwave mechanism because of a paper jam, the loading level of the microwave mechanism changes. Therefore, provision has been made according to the invention for ultrasound apparati to be present inside the microwave mechanism, which can detect reflected ultrasound waves inside the microwave mechanism via ultrasound emitters and corresponding ultrasound receivers, and then analyze them such that, preferably automatically, a determination can be made as to whether the volume of the printing medium has increased beyond a preset limit. When too many media are in the microwave mechanism, one may assume that the printing media have jammed or heaved. Then, appropriate measures may be taken to prevent and/or decrease damage caused by the undesired effects of the microwave mechanism that are then anticipated to occur.

To detect the degree to which the microwave mechanism is loaded with printing media, provision has been made with respect to the apparatus for the acoustical sensor to include the above-mentioned ultrasound emitter and a corresponding receiver. It is, however, also possible to use other sound ranges for this purpose that are either audible or not audible by the human ear. However, a non-audible sound emitter, in particular, an ultrasound emitter, is preferably be used.

In another beneficial embodiment of the process according to the invention, provision is made for the undesired effect of the microwave radiation to be detected by sensing a change in the temperature of the printing medium. For this purpose provision, is made with respect to apparati for at least one temperature sensor.

The undesired effect of the microwave radiation can cause the printing medium to heat up to such an extent that it begins to burn or smolder. This can be effectively prevented, by detecting in advance, that the printing medium is heating up beyond a set limit value so that countermeasures that limit the undesired effect can be initiated before the printing medium catches fire.

In a particularly beneficial embodiment of the invention, provision is made with respect to the process for the temperature to be optically ascertained.

For this purpose, provision is made for the temperature detector to incorporate optical elements to scan optically discernible changes in the printing medium that are a function of temperature.

For example, it can be concluded that the printing medium's temperature has changed whenever a change in the infrared radiation emitted from the printing medium is detected. These changes can then be detected and appropriate measures for preventing damage can be initiated.

For this purpose, provision can beneficially be made for a photodiode that is sensitive in the infrared range, or a camera that is sensitive in this range, to be used as the optical element of the temperature detector.

These optical elements can be located either inside the microwave mechanism or downstream therefrom. Care must be taken in this regard to install these optical elements in direct proximity downstream from the microwave emitter so that a pertinent change in temperature can be quickly detected.

In another embodiment, it is possible within the framework of optical detection that the color value of the printing medium and/or the layer of toner on the printing medium be sensed either across the entire surface of the printing medium or only in specific areas and on the upper side of the printing medium and/or on the bottom side of the printing medium. Overheating of the printing medium and/or the toner results in a corresponding change in color value.

This detection can, for example, be done directly downstream from the microwave mechanism. The detected color value can be compared with stored set color values. If the actual value differs from the set value, it can be assumed that the printing medium and a possibly present layer of toner have become overheated inside the microwave mechanism. After detection has taken place, a recurrence can then be prevented by appropriate countermeasures. As long as the temperature of the printing medium or the toner, remain within a range of tolerance, no changes in the color value of the toner or the printing medium will occur. A change in the color value makes the printing medium unsuitable for further use. Therefore, a change indicates that overheating has taken place. The microwave mechanism can preferably be turned off as a countermeasure.

Measurement of the change in color value can be done, for example, in un-imprinted areas of the printing material. In this way, knowledge of the chromaticity of the printing medium is sufficient for ascertaining the change. Such an area can be located directly on the un-imprinted lower side of the printing medium or within another un-imprinted area.

Measurement can also be made in imprinted areas. For this purpose, comparison with corresponding data pertaining to the set color values of the areas within the measured area would be necessary. These data for printing in electronic format can typically be found and accessed in pertinent storage media.

For measuring the color values according to the invention, special color value detection systems can be used, such as the ones already being used to ascertain the color value of a raised image.

In addition to these possibilities, a change in the optical characteristics of the printing medium can be ascertained by identifying the gloss value of certain predetermined areas of the printing medium. The gloss value can then be detected by a traditional gloss measuring system containing the related evaluation mechanism.

A buildup of bubbles inside the layer of toner occurs when either the printing medium or the layer of toner on the printing medium is overheated. The bubbles are caused by water evaporating out of the toner. Bubbles can be caused in the same manner directly inside the printing medium, if water that is evaporating too quickly can no longer escape from the printing medium at an even rate. The bubbles change the gloss value of the layer of toner. If, then, there is a difference between the actual gloss value of the layer of toner and the set value, preferably measured directly downstream from the microwave mechanism, then it can be assumed that impermissibly high heating of the toner occurred inside the microwave mechanism. In this event, appropriate countermeasures can be taken.

In a further embodiment of the process aspect of the invention, provision is made for detecting temperature change by identifying the change in reverse power of the microwave mechanism.

When resonant and constant limiting conditions prevail inside the microwave mechanism, as is for example the case inside a microwave fuser mechanism, then the power reflected in the mechanism is, of course, still a function of the printing medium being used, but it is characteristically nearly constant for the particular printing medium.

To maintain the functional efficiency of the microwave mechanism, in particular the microwave emitter, which generates the microwaves, provision is made for the reverse power to be directed into a special area of the microwave mechanism, referred to as the circulator. In this area, a water sink is put in place that can absorb the superfluous reverse power without causing damage inside the microwave mechanism.

Preferably the reverse power should be detected in the area of this water sink.

If the same printing medium is always used, or if the characteristic values of the reverse power for the different printing media that are used are known, the measured reverse power can be compared with the expected values. The reverse power is particularly a function of the level of moisture in the printing medium being used.

To measure this reverse power, provision is made according to the invention for at least one power-measuring element, which is incorporated in the detecting mechanism. According to the invention, this power measuring element should, for practical purposes, be placed in the area of the water sink where it can, for example, detect the temperature of the water sink or the level of the reverse power that is radiated into the water sink.

One limiting condition that affects the level of reverse power is the temperature of the printing medium itself. A change in the temperature of the printing medium leads to a change in the level of moisture in the printing medium, which in turn changes the resonance conditions within the microwave mechanism. A change in the resonance conditions leads to a corresponding change in the reverse power measured. If the level of the detected reverse power is then too different from the expected level, an impermissibly large increase in temperature of the printing medium can be assumed. In such case appropriate countermeasures can be initiated.

If the impermissible effects of the microwave radiation are due to electrical discharge inside the mechanism, such effects will not necessarily involve significant heating of the printing medium. Electrical discharge can result in at least isolated point damage within the printed image or the printed medium and/or adverse effects upon the operation of the microwave mechanism itself. For example, electric arcing can occur. If an electric arc runs through the printing medium, the printing medium can catch on fire.

Consequently, provision according to the invention is made for detecting electrical discharge within the microwave mechanism. It then becomes possible to initiate countermeasures to prevent or act against such electrical discharge and/or damage to the printing medium and/or the layer of toner.

To detect electrical discharge, provision is made for at least one electrical discharge detection mechanism to be located in the area of the microwave mechanism.

Provision is made in an embodiment of the invention for an electrical discharge to be detected optically. When an electrical discharge takes place, a bright flash of light occurs inside the microwave mechanism, which can, for example, be detected by a photodiode or another type of sensor such as, for example, a photomultiplier or even by other image detection mechanisms.

The optical sensor according to the apparatus aspect of the invention should be incorporated into the electrical discharge detection mechanism. Thus, for example, a photodiode can be integrated directly into the microwave mechanism. For this purpose, a suitable bore hole for at least this component of the electrical discharge detection mechanism can be provided in the applicator. The photodiode can, for practical purposes, be sensitive in the visible and/or the UV light range.

When an electrical discharge occurs inside the microwave mechanism, the electrical field cannot be maintained, and it breaks down. Consequently, process-related provision is beneficially made for detecting an electrical discharge.

For this purpose, apparatus-related provision is made for incorporating into the electrical discharge detection mechanism at least one measuring diode for detecting the changes in the electrical field inside the microwave mechanism.

This measuring diode is installed over a suitable opening in the area of the microwave mechanism such that the electrical field is measurable during operation of the microwave mechanism. The measuring diode can beneficially be aligned such that it is positioned in an area of high field strength. An ordinary diode for measuring electrical fields can be used as the measuring diode. By means of a pin made as short as possible, a tube, or another feed-in that adversely affects the microwaves inside the microwave mechanism as little as possible, the diode can be positioned inside the applicator itself in an area that exhibits the highest possible field strength. During the positioning, care should be taken that neither the propagation of microwaves, nor the effect of the microwaves on the printing medium, nor the travel of the printing medium through the microwave mechanism is adversely affected by the measuring diode or, if such positioning cannot be achieved without adverse effects, then such effects should at least be kept as small as possible.

If a substantial decrease in the field strength being measured by the measuring diode occurs, suitable measures may be taken to prevent damage to the printing medium and/or the microwave mechanism. Preferably, the microwave mechanism is immediately turned off.

When an electrical discharge takes place, not only does the described optical phenomenon occur, but the phenomenon is also accompanied by an acoustic effect that is caused by the discharge. The difference between this sound and the normal operational sounds can be viewed as nothing short of characteristic for an electrical discharge.

Therefore, in a further beneficial embodiment of the invention, provision is made for the electrical discharge to be detected acoustically.

Consequently, provision is also made according to the invention for the electrical discharge detection mechanism to incorporate at least one acoustical sensor. This sensor may, in particular, be in the form of a microphone. This microphone can be installed directly on or in the housing of the microwave mechanism. Additional analytical mechanisms of the electrical discharge detection mechanism can then be connected directly to the microphone. They can then be located at least in the general area of the microwave mechanism.

By the microphone, the noises inside the machine can then, for example, be sensed and analyzed. For this purpose, provision can be made according to the invention to distinguish by means of a frequency filter between the normal sounds and the characteristic sound of an electrical discharge. If an electrical discharge is detected, it will be possible to initiate countermeasures to prevent damage.

In particular beneficial embodiment of the invention, provision is made for a countermeasure to prevent burning of the printing medium.

Provision can be made for simultaneously stopping the travel of the printing medium through the microwave mechanism. In the event that no paper jam is detected, the printing medium shall continue to be conveyed at least until no more printing media are located in the microwave mechanism. It is particularly possible thereby, even though further feeding of the printing medium is immediately stopped, to continue conveying the printing medium until the last printing medium has been conveyed out of the microwave mechanism.

In order to avoid further damage while printing media are still inside the microwave mechanism, it is particularly beneficial if the microwave mechanism is immediately turned off. It can also be possible that the microwave radiation from the microwave mechanism be cut off, but turning off the microwave mechanism is preferred.

Detection of the impermissible effect can be accomplished in one or more of the ways described above.

Provision is beneficially made for locating at least one mechanism for executing the countermeasures in the area of the microwave mechanism, preferably downstream from the microwave mechanism.

If, for example, it is ascertained by one of the described processes, that ignition or burning of the printing medium is imminent, countermeasures can be initiated to prevent this from happening. In the ideal case, all damage inside the printing machine can be prevented.

If it is ascertained by the processes, that the printing medium is already burning, or is at least so overheated that ignition can no longer be prevented, countermeasures that fight the blaze effectively according to the invention can be initiated.

In this regard, provision can be made, for example, for two or more of the above-described processes to be used simultaneously and for ascertaining from the totality of the assembled data the actual status of the printing medium inside and/or downstream and/or upstream from the microwave mechanism. One can consider, for example, the possibility of a jam or another prolonged presence of the printing material even upstream from the microwave mechanism.

It can also be possible in this regard to look at two different limit values in some processes. In such case, an initial limit value that has been exceeded can indicate gross overheating of the printing medium. If, then, a second limit value is exceeded, the printing medium will have already caught on fire or will be on the verge of doing so.

In a beneficial embodiment, provision is made for suppressing the burning of the printing medium by cutting off the supply of oxygen.

In a special embodiment, provision is made for a burning or smoldering of the printing medium to be extinguished by causing safety gas to flow into the area. For this purpose, provision is made for a suitable gas flooding mechanism that includes at least those areas of the microwave mechanism in which printing media are located. In particular, this apparatus can extend into the space downstream and upstream from the microwave mechanism.

By this gas-flooding mechanism, the oxygen in this area can be replaced by non-flammable safety gas. Provision is made for this to occur in a closed space that suffices to completely extinguish a smoldering or burning printed medium.

It is also possible for the oxygen to be pumped directly out of such a limited area of the printing machine and/or the microwave mechanism. In this way the introduction of oxygen is also prevented. For this purpose, appropriate pumps can be incorporated.

Also, provision is made in an additional beneficial step in the process for the burning of the printing medium to be suppressed with mechanical suppression measures.

This approach makes it possible to suppress a blaze in a particularly simple manner.

For this purpose, provision is made for appropriate mechanical suppression measures, which are incorporated into the mechanism for executing countermeasures. According to the invention, a pair of rollers can be placed downstream from the microwave mechanism. In the normal situation, these rollers are located at a certain distance from the printing medium so that they do not touch it. If a fire or an overheating or another impermissible effect of the microwave radiation on the printing medium is detected, provision can be made for the rollers to be moved together to envelop the printing medium such that the smoldering or burning is extinguished.

Additionally, a pad may be used to extinguish a possible fire upon an appropriate signal. This pad can consist of a mechanical apparatus whose surface is greater than that of the printing medium being used. When a possible fire arises it can be dropped onto the printing medium where it will extinguish the fire by preventing additional oxygen from reaching the blaze.

BRIEF DESCRIPTION OF THE DRAWING

An embodiment of the detection mechanism according to the invention for detecting an undesired effect of the microwave radiation and the mechanism for executing suitable countermeasures is described in greater detail using a drawing from which additional characteristics according to the invention may be derived, but to which the scope of the invention is not limited.

The sole FIGURE shows a schematic image of a microwave mechanism with its own detection mechanisms and possible mechanisms for executing suitable countermeasures.

DETAILED DESCRIPTION OF THE INVENTION

Figure 1:
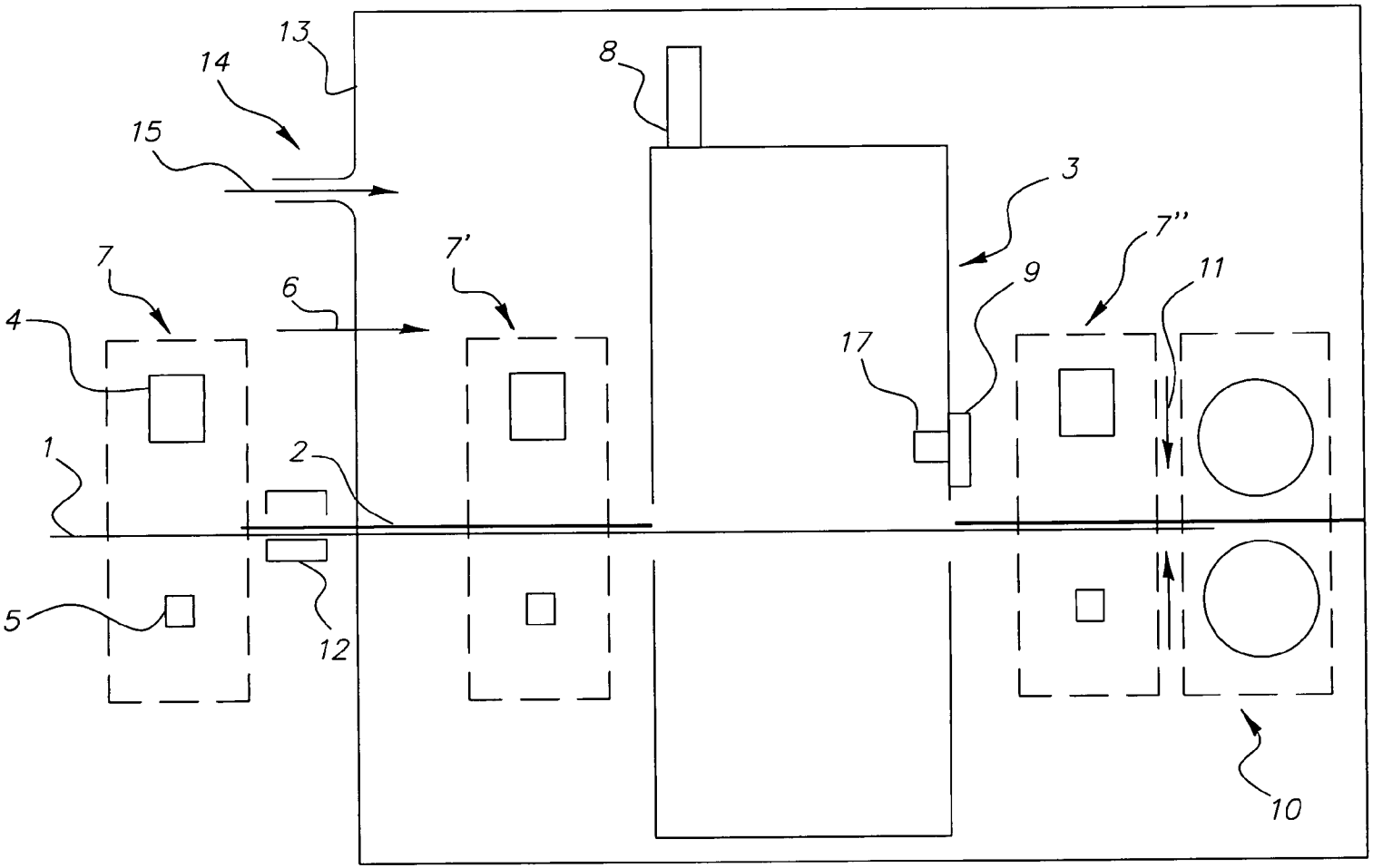

A sheet of paper 2 is conveyed within a travel path 1 in the direction of the arrow 6. The sheet of paper 2 runs through a microwave mechanism 3. This mechanism is, in particular, a microwave fuser mechanism. In particular, the view shown is from the side such that the visible edges of the microwave mechanism 3 are co-terminus with the sides of an applicator that is encompassed by the microwave mechanism 3. Inside the applicator, the sheet of paper 2 is subjected to microwave radiation. Upstream and downstream from the microwave mechanism 3 are paper jam detection mechanisms in the form of a total of three light barriers 7, 7' and 7", each of which includes an emitter unit 4 and a receiver 5. Any suitable control arrangement may be operatively connected to the various sensors and mechanisms within the fuser mechanism to control operation of the fuser mechanism and the fault prevention apparatus associated therewith.

Before the sheet of paper 2 reaches the microwave mechanism 3 it runs through a paper weight detection mechanism 12. This mechanism can also be located at a different place within the travel path 1 of the sheet of paper 2 upstream from the microwave mechanism 3.

The movement of the sheet of paper 2 inside of the microwave mechanism 3 along the travel path 1 should, in particular, proceed without contact.

For example, in the case of a one-sided imprinted sheet of paper 2, a transparent conveyor belt that does not become heated from the microwave radiation and on which the sheet of paper 2 is conveyed along the travel path 1 may, for example, be provided. In the area of the microwave mechanism 3 are additional detection mechanisms for the detection of an undesired effect of the microwave radiation. Included in this number are a temperature detector 8 and an electrical discharge detection mechanism 9. The temperature detector 8 can, for example, contain an optical element in the form of an infrared sensor, while the electrical discharge detection mechanism 9 in the case shown here incorporates an electric measuring diode 17, which can, for example, be integrated inside a pin. This measuring diode 17 is used to measure the field strength in the microwave mechanism 3. The measuring diode 17 should be positioned such that it is located mainly in an area of high field strength. The pin or the measuring diode 17 should be as short as possible so that it does not adversely affect the microwaves inside the microwave mechanism 3.

Upstream from the microwave mechanism 3 are two light barriers 7 and 7' that are traversed by the sheet of paper 2 one after the other.

In the example shown here, a toner (not shown) is to be fused to the sheet of paper 2 by the microwave mechanism 3. After running through the microwave mechanism 3, the sheet of paper 2 then runs through an additional light barrier 7".

Before the sheet of paper 2 is conveyed into the microwave mechanism 3 it runs through the paper weight detection mechanism 12, which includes here, as an example, a low-power microwave mechanism.

If this paper weight detection mechanism 12 detects that the sheet of paper 2 is incorrect, i.e., is in particular a sheet of paper 2 with an incorrect paper weight, the microwave mechanism is turned off.

If no additional faults are detected with respect to the sheet of paper 2, so that a paper jam is not expected to occur, then provision can be made for the sheet of paper 2 to continue to be conveyed without being further subjected to microwaves.

A signal can then be given to the operator that a sheet of paper 2 with an incorrect paper weight is in the printing machine and should be removed.

Provision can also be made for stopping both the microwave mechanism 3 and conveyance of the sheet of paper 2, and the sheet of paper 2 can then be manually removed.

Downstream from the microwave mechanism 3, the sheet of paper 2 can be conveyed along the travel path 1 by a conveyor belt that is not shown.

Located downstream from the light barrier 7" and directly above and below the travel path 1 is a pair of rollers 10 acting as a mechanical suppressor. The two rollers of roller pair 10 can be moved in the direction of the arrows 11 toward the conveyor belt. Movement in the opposite direction, for example, to separate them, is also possible.

The distance between the two light barriers 7 and 7" upstream from the microwave mechanism 3, as discussed below, here should be approximately 250 mm. This distance is sufficient for the example shown here to detect a paper jam in a timely manner without a sheet of paper 2 located in the microwave mechanism 3 catching fire. The distance according to the invention can, however, be shorter.

When the sheet of paper 2 is traveling at a different rate or the amount of time required for the sheet of paper to catch fire or begin to smolder is different, other distances can be selected that are attuned to these parameters.

If the sheet of paper 2 is assumed to be traveling at 500 mm/sec and the time period before the sheet of paper 2 will begin to smoke while being subjected to microwave radiation, this distance of 250 mm between the light barriers 7 and 7' is sufficient for detecting that a sheet of paper 2 failed to be present at light barrier 7 at the appropriate time, resulting in a so-called missing sheet of paper. A missing sheet of paper occurs when an expected sheet of paper is not detected at the expected time. In the event of a missing sheet of paper, conveyance of additional sheets of paper 2 can be stopped and the microwave mechanism turned off. For this purpose, stop mechanisms are provided, which are not shown in the FIGURE, but which disengage the microwave mechanism or, for example, interrupt the power to the microwave mechanism 3.

Because the stopping of the microwave fuser mechanism occurs in a timely manner before the sheet of paper 2 begins to burn, an open fire inside the printing machine can be successfully prevented.

When the printing machine is operating correctly, the sheet of paper 2 runs through the microwave mechanism after passing the light barrier 7'.

If, now, a paper jam occurs or the sheet of paper 2 remains for a prolonged period of time inside the microwave mechanism 3 for a prolonged period of time, and this is not detected by light barriers 7 and 7', or if an overly energy-rich microwave radiation impinges on the sheet of paper 2 for some other reason, or if an electrical discharge occurs, then such an event can be quickly detected by the temperature detector 8 and the electrical discharge detection mechanism 9. The microwave mechanism 3 can then be caused to turn off by the switching system (not shown in the FIGURE) and/or the stop mechanisms (not shown).

The temperature detector 8 is provided for the purpose of detecting the infrared radiation emitted from the sheet of paper 2 and for comparing it with a limit value. In this way, the temperature of a sheet of paper 2 inside the microwave mechanism 3 can be controlled. If the temperature exceeds a set limit value, the emission of microwaves can be interrupted by the stop mechanism. For this purpose, it is not necessary that the temperature be ascertained; it is sufficient if the total energy of the radiation being measured by the temperature detector 8 exceeds a certain value.

If an electrical discharge occurs inside the microwave mechanism 3 it can be detected by the measuring diode 17. This diode measures the field strength inside the microwave mechanism 3. When an electrical discharge occurs, the electrical field in the interior of the microwave mechanism breaks down, which fact is then detected by the measuring diode 17 or the electrical discharge detecting mechanism 9. Thereupon, operation of the microwave mechanism, is caused to be stopped.

After the sheet of paper 2 has run through the microwave mechanism 3, it passes an additional light barrier 7". Here, too, for the same fuser unit configuration, the distance back to the previous light barrier 7' is no more than 250 mm. If this light barrier 7" does not detect a sheet of paper at the expected point in time, the assumption is made that a paper jam has occurred or at the least that the sheet of paper 2 spent a prolonged period of time inside the microwave mechanism 3. This paper jam should have occurred inside the microwave mechanism or shortly downstream therefrom, because the sheet of paper 2 was correctly detected at light barrier 7'. On the basis of this detected paper jam, the microwave mechanism 3, is once again caused to be stopped. In addition, further conveyance of the sheet of paper is interrupted.

If an undesired effect of the microwave radiation on the sheet of paper is detected by the temperature detector 8 or the electrical discharge detection mechanism 9, a smoldering or burning of the sheet of paper 2 must be prevented or suppressed. For this purpose, a gas flooding mechanism 13 separates the microwave mechanism 3 spatially from the rest of the printing machine.

If a paper jam is detected by either light barrier 7' or 7", the microwave mechanism 3 and conveyance of the sheet of paper are disengaged.

Provision has been made that, if a paper jam is detected and, in addition, an undesired effect of the microwave radiation on the sheet of paper 2 is detected by the temperature detector 8 and/or the electrical discharge detection mechanism, a possible fire or smoldering on the part of the sheet of paper 2 will be prevented by the admission of a non-flammable safety gas 15 through an inlet 14 into the gas flooding mechanism 13.

Simultaneously, conveyance of the sheet of paper is interrupted and the microwave mechanism is disengaged.

The gas should beneficially be fed under pressure so that the safety gas 15 can distribute itself quickly enough in the gas flooding mechanism 13 to extinguish or prevent a fire or smoldering. Provision can also be made, in particular, for two or more inlets 14 for the safety gas 15 to be installed.

Because generally the microwave mechanism 3 is not completely sealed by the gas flooding mechanism 13, safety gas 15 will always leak out of the gas flooding mechanism 13. Provision is therefore made according to the invention for safety gas 15 to be continuously injected.

Flooding of the gas flooding mechanism 13 should be continued until the temperature of the sheet of paper 2 has clearly cooled off to the extent that reignition of a flame can no longer be expected to occur. Provision can be made in particular for the safety gas 15 to be injected into the gas flooding mechanism 13 at a low temperature.

If light barriers 7, 7', and 7" do not detect a missing sheet even though an undesired effect of the microwave radiation is detected by the temperature detector 8 or the electrical discharge detection mechanism 9, which could in particular be an undesired heating up of the sheet of paper 2 or an electrical discharge, then provision can next be made for the gas flooding mechanism 13 to be flooded with safety gas 15 until the sheet of paper 2 is sufficiently cool. For this purpose, provision should be made for both the microwave mechanism 3 and conveyance of the sheet to be disengaged.

Provision can also be made for stopping the microwave mechanism 3, but continuing to convey the sheet of paper 2. In this way, the sheet of paper 2 can come out of the microwave mechanism. It will then continue to be conveyed into the area of the roller pair 10. After the undesired effect has been detected, the roller pair 10 will be operated such that both rollers move toward one another in the direction of arrow 11, and the sheets of paper 2, which are now being conveyed between the pair of rollers 10, will be so enveloped that no oxygen can reach them and thus a possible fire or smoldering will be prevented or suppressed. For this purpose, the roller pair 10 is such that the outer surfaces of the rollers are non-flammable and are elastic in a way that allows the rollers to be turned even when they are enveloping the sheet of paper 2. The sheet of paper 2 is therefore conveyed through the roller pair 10 that is rolling over it and possible burning points are extinguished in the process. In this way, a fire in the printing machine can be prevented.

An additional run through the roller pair 10 can be provided for a sheet of paper 2 that was extinguished and cooled off by safety gas inside the microwave mechanism during a cessation in the conveyance of the sheet of paper 2. A fire can be prevented in this way with greater certainty.

So that additional sheets of paper 2 are not conveyed into the microwave mechanism 3, where they could possibly cause more damage, provision is made for preventing conveyance of the sheets of paper after the first sheet of paper 2 has run through the roller pair 10. It can also be possible that for this purpose one waits for the time when no additional sheets of paper 2 are located in the area of the microwave mechanism 3. In particular, provision can be made for this purpose for preventing additional sheets of paper 2 from being fed into the printing machine, in particular, into the area of the microwave mechanism 3.

In this way, damage can be prevented that can otherwise be caused by undesired effects of the microwave radiation inside a printing machine.

What is claimed is:

1. A process for preventing damage inside a printing machine caused by microwave radiation emanating from microwave mechanisms, preferably microwave fuser mechanisms (3), comprising: an undesired effect of the microwave radiation is automatically detected, and limiting said detected undesired effect by countermeasures, wherein an incorrect paper weight of a printing medium is detected.

2. A process for preventing damage inside a printing machine caused by microwave radiation emanating from microwave mechanisms, preferably microwave fuser mechanisms (3), comprising: an undesired effect of the microwave radiation is automatically detected, and limiting said detected undesired effect by countermeasures, wherein a prolonged presence of printing medium in the area of the microwave mechanism (3) is detected.

3. A process according to claim 2, wherein detection is optically accomplished by at least one optical sensor.

4. A process according to claim 2, wherein detection is acoustically accomplished by at least one acoustical sensor.

5. A process for preventing damage inside a printing machine caused by microwave radiation emanating from microwave mechanisms, preferably microwave fuser mechanisms (3), comprising: an undesired effect of the microwave radiation is automatically detected, and limiting said detected undesired effect by countermeasures, wherein an electrical discharge inside the microwave mechanism (3) is detected.

6. A process according to claim 5, wherein an electrical discharge is optically detected.

7. A process according to claim 5, wherein an electrical discharge is electrically detected.

8. A process according to claim 5, wherein an electrical discharge is acoustically detected.

9. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein a paper weight detection mechanism (12) is provided, preferably in the area upstream from said microwave mechanism (3).

10. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein a paper jam detection mechanism is provided in the area of said microwave mechanism (3).

11. An apparatus according to claim 10, wherein said paper jam detection mechanism includes at least one optical sensor.

12. An apparatus according to claim 10, wherein said paper jam detection mechanism includes at least one acoustical sensor.

13. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein said detection mechanism includes at least one temperature detector, said detection mechanism including power measurement elements for detecting reverse power of said microwave mechanism (3).

14. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein at least one electrical discharge detection mechanism (9) is provided in the area of said microwave mechanism (3), said electrical discharge detection mechanism (9) including at least one optical sensor.

15. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein at least one electrical discharge detection mechanism (9) is provided in the area of said microwave mechanism (3), said electrical discharge detection mechanism (9) including at least one electrical diode (17) for detecting changes in said electric field inside said microwave mechanism (3).

16. An apparatus for the prevention of damage inside the printing machine caused by microwave radiation emanating from microwave mechanisms (3), preferably microwave fuser mechanisms, comprising: at least one detection mechanism for the detection of an undesired effect of microwave radiation, and at least one mechanism for the execution of suitable countermeasures in response to detection of an undesired effect by said at least one detection mechanism, wherein at least one electrical discharge detection mechanism (9) is provided in the area of said microwave mechanism (3), said electrical discharge detection system (9) including at least one acoustical sensor.

* * * * *